US009579258B2

(12) United States Patent
Fukuoka

(10) Patent No.: US 9,579,258 B2
(45) Date of Patent: Feb. 28, 2017

(54) DRUG DELIVERY DEVICE

(75) Inventor: Koji Fukuoka, Osaka (JP)

(73) Assignee: KOBAYASHI & CO., LTD., Tokyo (JP)

( * ) Notice: Subject to any disclaimer, the term of this patent is extended or adjusted under 35 U.S.C. 154(b) by 0 days.

(21) Appl. No.: 14/389,566

(22) PCT Filed: Apr. 2, 2012

(86) PCT No.: PCT/JP2012/058841

§ 371 (c)(1),
(2), (4) Date: Sep. 30, 2014

(87) PCT Pub. No.: WO2013/150576

PCT Pub. Date: Oct. 10, 2013

(65) Prior Publication Data

US 2015/0101706 A1 Apr. 16, 2015

(51) Int. Cl.
*A61J 1/20* (2006.01)
*B65B 3/00* (2006.01)

(52) U.S. Cl.
CPC ..... *A61J 1/2096* (2013.01); *B65B 3/003* (2013.01); *A61J 1/201* (2015.05); *A61J 1/2072* (2015.05); *A61J 1/2086* (2015.05)

(58) Field of Classification Search
CPC ..... A61J 1/14; A61J 1/2096
USPC ..... 141/27, 311 R, 312, 318, 319, 321, 322, 141/326, 329, 330, 346, 351, 352, 353, 141/357, 369, 370, 372, 383, 384, 385, 141/386; 604/411, 415
See application file for complete search history.

(56) References Cited

U.S. PATENT DOCUMENTS 3,608,550 A 9/1971 Stawski
4,564,054 A * 1/1986 Gustavsson ..... A61J 1/2096 141/329

(Continued)

FOREIGN PATENT DOCUMENTS

GB 1 267 419 A 3/1972
JP 60-501294 A 8/1985

(Continued)

OTHER PUBLICATIONS

International Search Report dated Jun. 12, 2012, issued in corresponding application No. PCT/JP2012/058841.

*Primary Examiner* — Timothy L Maust
*Assistant Examiner* — Andrew Schmid
(74) *Attorney, Agent, or Firm* — Westerman, Hattori, Daniels & Adrian, LLP

(57) ABSTRACT

The drug delivery device (1) connects an syringe barrel (6) and a drug container (2) by means of a closed system, and delivers a drug between the syringe barrel and drug container through said closed system. This drug delivery device includes a first member (8) connected to the drug container (2) on the side of a stopper (4), and a second member (30) connected at one end to the first member and connected at the other end to the syringe barrel (6). The first member and the second member are connected by a fitting mechanism. A second hollow needle member (34) provided on the second member faces towards the first member, and the tip portion (36) and the base portion (38) are fixed. The first member has a first hollow needle member (12). The first member and the second member each have an elastic member (18 and 40).

6 Claims, 10 Drawing Sheets

(56) References Cited

U.S. PATENT DOCUMENTS

| | | | | |
|---|---|---|---|---|
| 4,673,404 | A | 6/1987 | Gustavsson | |
| 5,122,123 | A | 6/1992 | Vaillancourt | |
| 7,886,779 | B2 * | 2/2011 | Smith | B01L 3/50825 141/23 |
| 2009/0216212 | A1 * | 8/2009 | Fangrow, Jr. | A61J 1/2096 604/406 |
| 2010/0147402 | A1 * | 6/2010 | Tornqvist | F16K 15/147 137/513 |
| 2011/0264069 | A1 | 10/2011 | Bochenko | |

FOREIGN PATENT DOCUMENTS

| | | | |
|---|---|---|---|
| JP | 5-200098 | A | 8/1993 |
| JP | 2010-521219 | A | 6/2010 |
| JP | 2010-525920 | A | 7/2010 |
| JP | 2010-528808 | A | 8/2010 |
| JP | 2010-528809 | A | 8/2010 |
| JP | 2010-528810 | A | 8/2010 |
| JP | 2010-537900 | A | 12/2010 |
| JP | 2011-512205 | A | 4/2011 |

* cited by examiner

DRUG DELIVERY DEVICE

TECHNICAL FIELD

The present invention relates to technology pertaining to devices for causing delivery of drug(s) between or among syringe barrel(s) and/or drug container(s).

BACKGROUND ART

Among the anticancer agents and other such hazardous medications which are used in medical facilities there are a wide variety of products which include therapeutic radioactive medications and the like. Hazardous medications are drugs which are used on a daily basis consistent with therapeutic objectives at medical facilities. However, as levels of mutagens detected in the urine of medical staff who work in environments where these are formulated or administered are high as compared with medical staff who have not been exposed thereto, there is concern that there may be adverse effect on reproductive function.

The U.S. Occupational Safety and Health Administration has published guidelines related to the handling of antineoplastic agents and other hazardous medications by medical staff, and regulations for the handling of hazardous medications have also been established at institutions such as the U.S. National Institutes of Health (NIH). However, during handling of hazardous medications at medical facilities, there are still many situations in which medical staff and patients are subjected to unintentional exposure by those hazardous medications. In such situations, it is frequently the case that the route by which exposure occurs is oral or transdermal exposure to the hazardous medication in liquid or gas form.

More specifically, exposure frequently occurs as a result of drug leakage or dripping at times such as when an infusion bag is being filled with a drug or when a drug is being transferred by suction from a drug container to a syringe during drug dispensing operations. Even more specifically, it is believed that following leakage the drug may come in direct contact with the skin, or that the drug in gasified form, or in particulate form and floating in the air where the drug has dried, may enter the body by inhalation.

In light of the foregoing situation, many medical devices have been developed for delivery of drug(s) between or among containers in which, where hazardous drugs are to be delivered between or among containers, employment of a closed system between or among those containers has been attempted in an effort to prevent medical staff and patients from being subjected to exposure by hazardous drugs (see Patent References Nos. 1 through 6).

PRIOR ART REFERENCES

Patent References

Patent Reference No. 1: Japanese Patent Application Publication Kokai No. 2010-521219

Patent Reference No. 2: Japanese Patent Application Publication Kokai No. 2010-525920

Patent Reference No. 3: Japanese Patent Application Publication Kokai No. 2010-528808

Patent Reference No. 4: Japanese Patent Application Publication Kokai No. 2010-528809

Patent Reference No. 5: Japanese Patent Application Publication Kokai No. 2010-528810

Patent Reference No. 6: Japanese Patent Application Publication Kokai No. 2010-537900

SUMMARY OF INVENTION

Problem to be Solved by Invention

However, in the conventional art, whereas a prescribed device is used to make connection in the form of a closed system between syringe barrel and drug container, with drug delivery being carried out between said syringe barrel and drug container, because a high degree of skill is required to operate said prescribed device, there is the problem that the operator must undergo training for a long period of time.

Furthermore, in the conventional art, because a high degree of skill is needed to operate the foregoing prescribed device, there has also been the problem that this acts to limit those who can be operators or to decrease the quality of medical service which is provided, and there has also been the problem that the frequency with which faulty operation occurs tends to increase increasing difficulty of operations.

In accordance with the present invention, a drug delivery device is therefore proposed in which, through a simple operation made possible by adoption of a simple structure, a syringe barrel and a drug container are connected by means of a closed system, and a drug is delivered between the syringe barrel and the drug container by way of said closed system.

Means for Solving Problem

One embodiment of a drug delivery device that is disclosed is a drug delivery device which has a first member that is connected to a stopper side of a drug delivery device, and a second member that is connected at one end thereof to said first member and that is connected at another end thereof to a syringe barrel, which carries out delivery of a drug between the drug container and the syringe barrel, and which is characterized in that: the first member has a male portion of an engagement mechanism for causing mutual connection to be made between said first member and the second member, and the second member has a female portion of said engagement mechanism, mutual engagement between the male portion and the female portion causing mutual connection to be made between the first member and the second member; wherein the second member has a second hollow needle member having a tip portion arranged so as to be directed toward the first member, and having a base portion arranged so as to be directed toward the syringe barrel, and also being such that the base portion is held in fixed fashion by a region at which connection is made with the syringe barrel, a hole for delivery of the drug being provided at each the base portion and at the tip portion; and a second elastic member capable of being penetrated by the second hollow needle member; wherein the tip portion of the second hollow needle member is supported in a state in which it is inserted in the second elastic member; wherein the first member has a first elastic member capable of being penetrated by the second hollow needle member; and a first hollow needle member having a tip portion arranged so as to be directed toward the stopper side of the drug delivery device, and having a base portion arranged so as to be directed toward the second member, the base portion and the tip portion each being provided with a hole, an inside diameter of which is larger than an outside diameter of the second hollow needle member, for delivery of the drug; wherein, when the hole toward the base portion side of the first hollow needle member is occluded by the first elastic member, and the first member and the second member are mutually connected, while in a state such that the first elastic member and the second elastic member mutually abut, the second hollow needle member penetrates said the first elastic member and second elastic member, and is inserted within the first hollow needle member which is inserted within the stopper of the drug container; and wherein delivery of the drug between the drug container and the syringe barrel is carried out by way of the first hollow needle member and the second hollow needle member which is inserted within said first hollow needle member.

Furthermore, one embodiment of a drug delivery device that is disclosed is characterized in that, in addition to the foregoing constitution, a first filter member for preventing entry of unwanted material into the first hollow needle member is provided between the hole at the base portion side of the first hollow needle member and the first elastic member.

Furthermore, one embodiment of a drug delivery device that is disclosed is characterized in that, in addition to the foregoing constitution, provided at an interior of the first hollow needle member is a second filter member for preventing entry of unwanted material into the top portion of said first hollow needle member.

Furthermore, one embodiment of a drug delivery device that is disclosed is characterized in that, in addition to the foregoing constitution, the first elastic member and the second elastic member are spherically shaped; a first fixing member that holds the first elastic member to the first member in fixed fashion, and a second fixing member that holds the second elastic member to the second member in fixed fashion, are each of bowl-like shape and have a hole at a base portion thereof; wherein arranging the first elastic member and the second elastic member at the bowl-like regions causes locations of the first elastic member and the second elastic member to be fixed.

Furthermore, one embodiment of a drug delivery device that is disclosed is characterized in that, in addition to the foregoing constitution, the first member has a drug container gripping portion that allows a size of a region at which connection occurs to be made to correspond to a magnitude of an outside diameter at the drug container stopper portion, and that squeezes on and holds the drug container stopper portion.

Furthermore, one embodiment of a drug delivery device that is disclosed is characterized in that, in addition to the foregoing constitution, the first filter member takes the form of a screen-like member in which a thread-like member is arranged in screen-like fashion, over which and rotated with respect to which by 45° there is a said screen-like member.

Benefit of the Invention

In a drug delivery device which is disclosed, through a simple operation made possible by adoption of a simple structure, syringe barrel(s) and drug container(s) are connected by means of closed system(s), and drug(s) are delivered between syringe barrel(s) and drug container(s) by way of said closed system(s).

EMBODIMENTS FOR CARRYING OUT THE INVENTION

Embodiments for carrying out the present invention will be described with reference to the drawings.

(Structure of Drug Delivery Device Associated with Present Embodiment)

Figure 1:
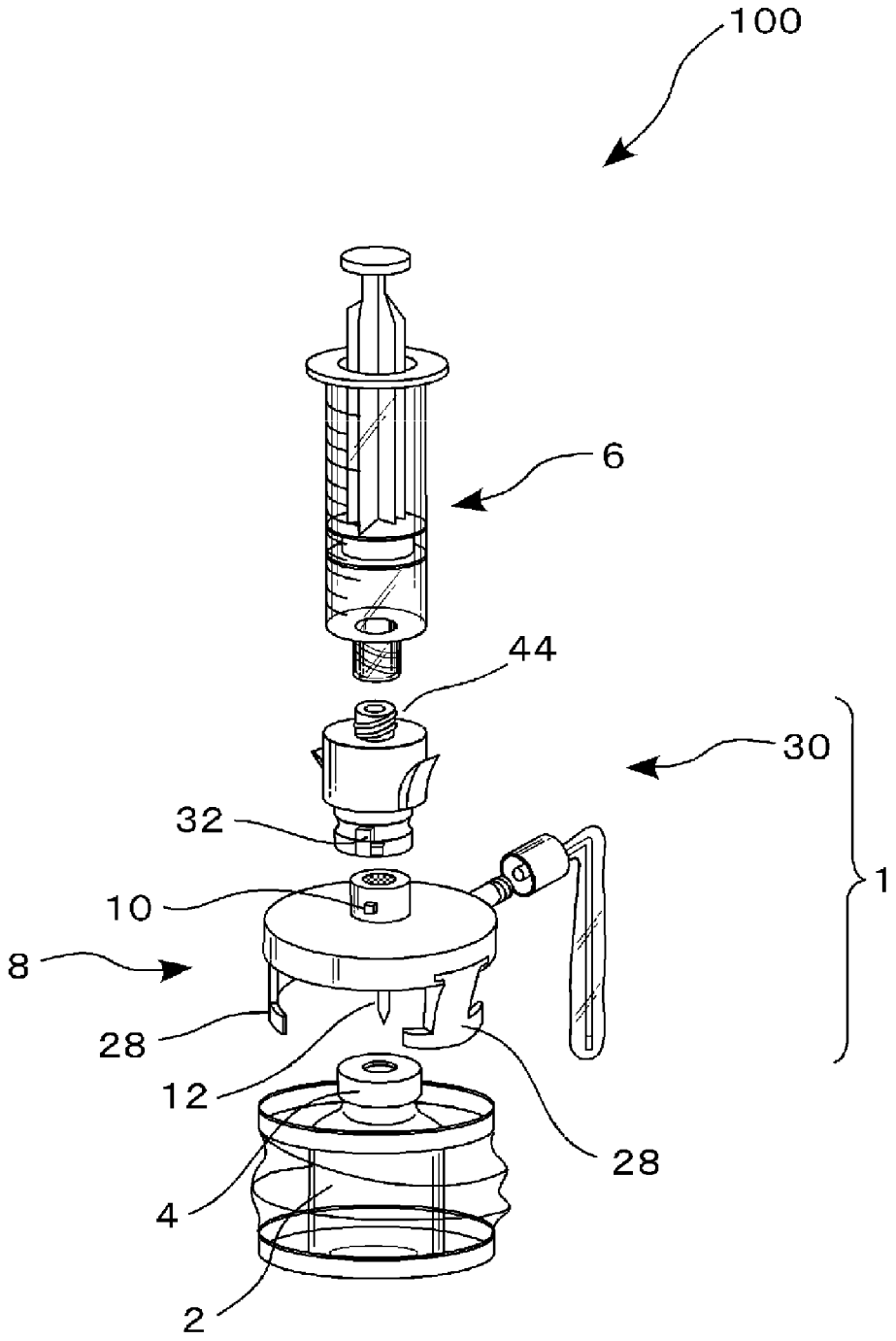
FIG. 1 Drawing showing an example of a drug delivery system which includes a drug delivery device associated with the present embodiment.

Structure of a drug delivery device 1 associated with the present embodiment will be described using FIG. 1 through FIG. 10. FIG. 1 is a drawing showing an overview of a drug delivery system 100 including drug delivery device(s) 1. As shown in FIG. 1, drug delivery system 100 has drug container(s) 2, first member(s) 8, second member(s) 30, and syringe barrel(s) 6.

Drug delivery system 100 uses first member(s) 8 and second member(s) 30 to cause connection between or among drug container(s) 2 and syringe barrel(s) 6, and with these in this connected state, to cause drug(s) in liquid and/or gas form to be delivered between drug container(s) 2 and syringe barrel(s) 6.

Figure 2:
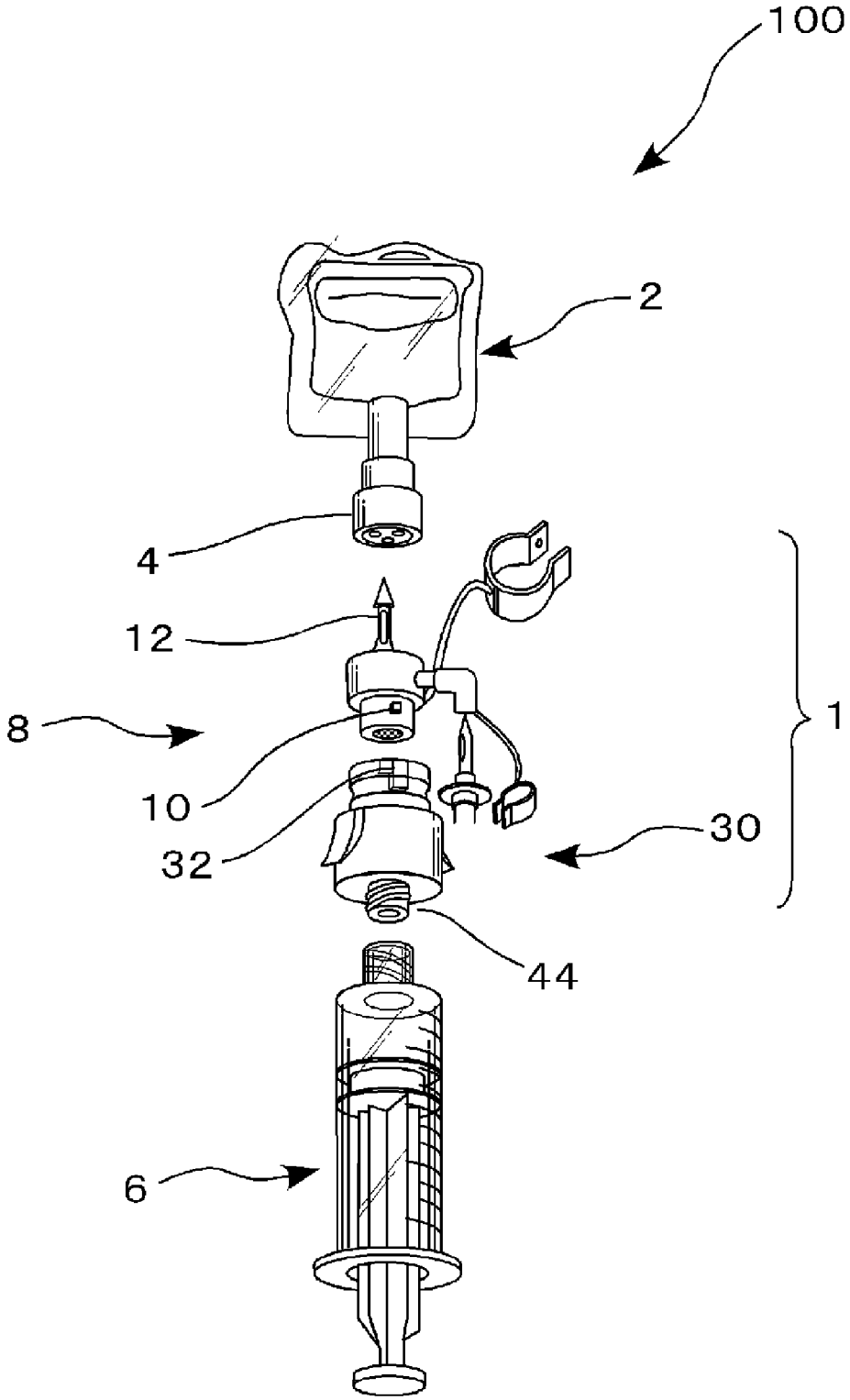
FIG. 2 Drawing showing an example of a drug delivery system which includes a drug delivery device associated with the present embodiment.
Figure 3:
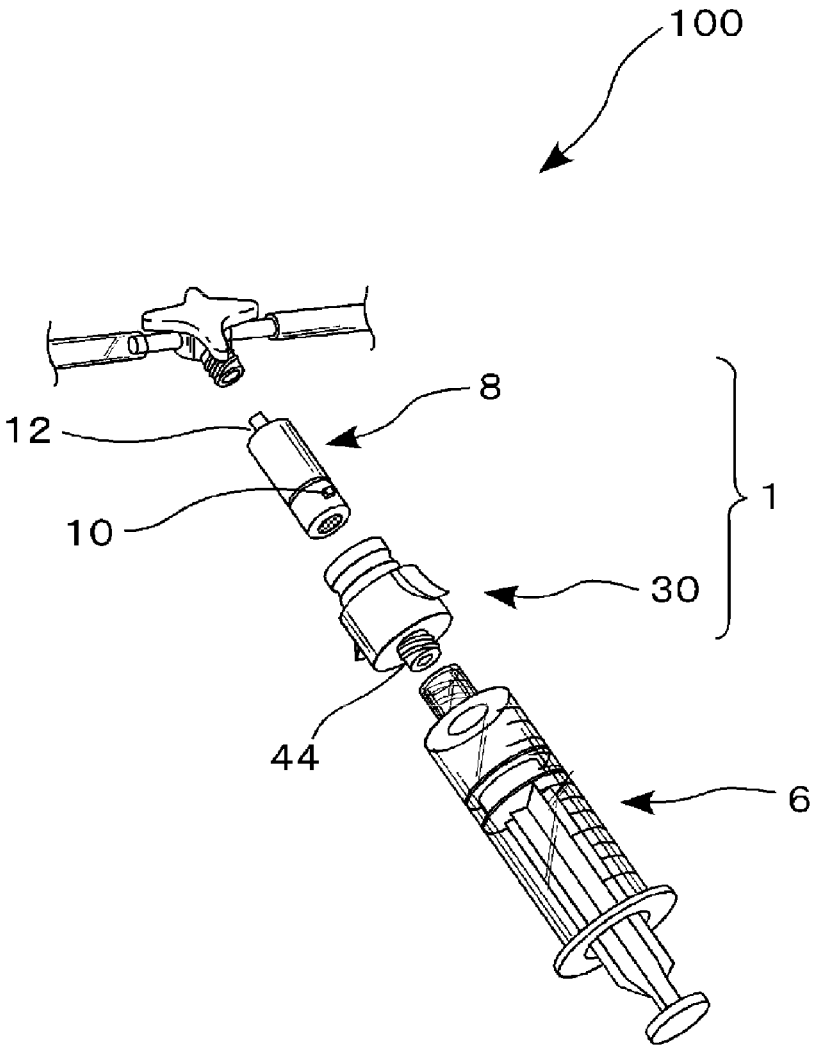
FIG. 3 Drawing showing an example of a drug delivery system which includes a drug delivery device associated with the present embodiment.

Drug container 2, which may be a vial (Vial) as shown in FIG. 1 or which may be an infusion bag as shown in FIG. 2, has stored therewithin drug(s) in solid, liquid, and/or gas form. As shown in FIG. 3, drug delivery device 1 is capable of being applied to a situation in which drug container 2 takes the form of an infusion line. Furthermore, drug container 2 is equipped with stopper(s) 4 which make connection(s) with other member(s) and which are used during delivery of drug(s). Drug container 2 is connected to first member(s) 8 on the side(s) thereof at which stopper(s) 4 is/are present.

Syringe barrel 6, also referred to as syringe (Syringe), is an apparatus for causing infusion and/or suction of drug(s) in liquid and/or gas form, and is not equipped with an injection needle. Syringe barrel 6 is connected to second member 30 at syringe barrel connection portion 44 provided on second member 30.

Furthermore, as shown in FIG. 1, first member 8 and second member 30 are mutually connected.

Figure 4:
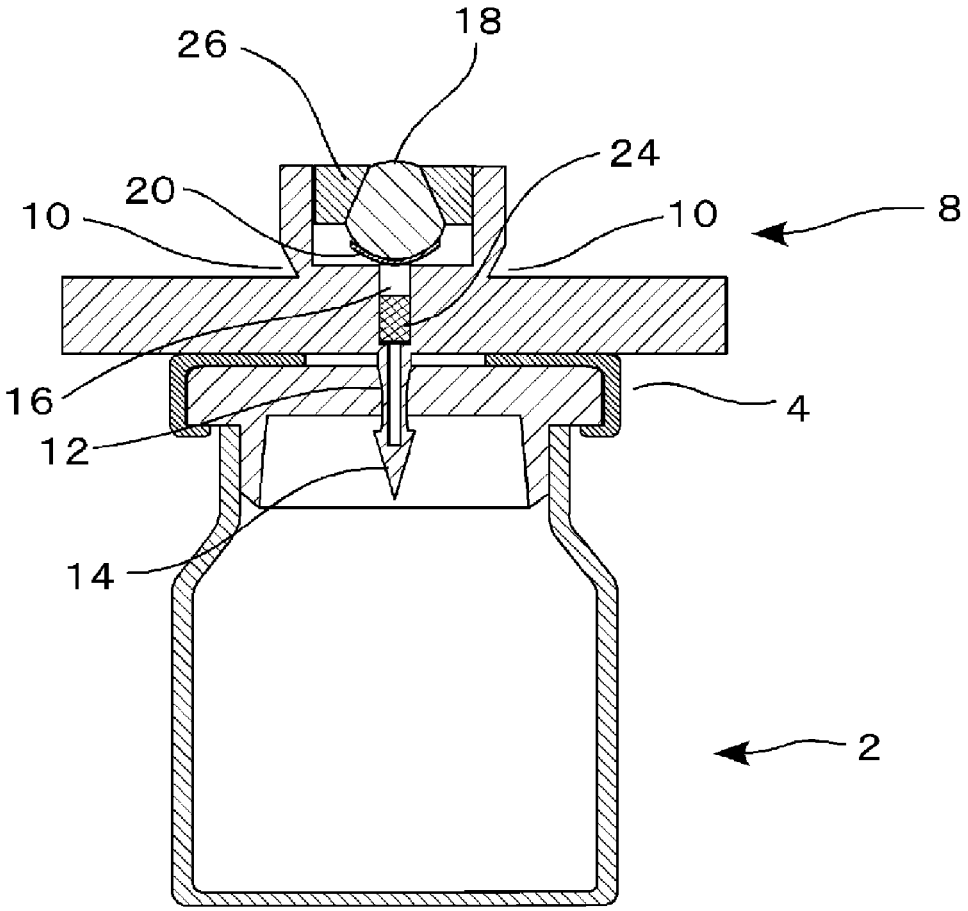
FIG. 4 Sectional view to assist in describing principal parts of a first member associated with the present embodiment.

Description of first member 8 will now be carried out using FIG. 4. FIG. 4 is a sectional view to assist in describing the principal parts of first member 8. As shown in FIG. 4, first member 8 has engagement mechanism male portion(s) 10, first hollow needle member(s) 12, first elastic member(s) 18, first fixing member(s) 26, first filter member(s) 20, second filter member(s) 24, and drug container gripping portion(s) 28.

Engagement mechanism male portion 10, which is the male portion of an engagement mechanism (locking mechanism) for causing mutual connection between first member 8 and second member 30, causes first member 8 and second member 30 to be mutually connected by means of a simple operation as a result of engagement with female portion 32 provided on second member 30, described below. This engagement mechanism might for example be a mechanism comprising a pawl-shaped female portion and a male portion shaped so as to engage with this pawl, first member 8 and second member 30 being capable of being easily locked in connected relationship as a result of the mutual engagement which is made to occur between this pawl and this region that engages with the pawl. Note that the foregoing engagement mechanism may have a structure which is other than this.

First hollow needle member 12, which is needle-shaped and has hollow interior, is such that tip portion 14 thereof is arranged so as to be directed toward stopper 4 of drug container 2, and is such that base portion 16 thereof is arranged so as to be directed toward the portion which makes connection with second member 30. Furthermore, liquid drug delivery between drug container 2 and syringe barrel 6 is carried out while in a state in which tip portion 14 is inserted within stopper 4 of drug container 2. For this reason, hole(s) for delivery of drug(s) are provided at least at tip portion 14 and base portion 16.

First elastic member 18 might for example be a spherically shaped member, the material of which is silicon, thermoplastic resin, or other such substance provided with elasticity. Furthermore, first elastic member 18 is held in fixed fashion at a prescribed location within first member 8 by first fixing member 26. Here, what is meant by a prescribed location is a location at which first elastic member 18 occludes hole(s) in base portion 16 of first hollow needle member 12.

First fixing member 26, as has been described, is a member for holding first elastic member 18 in fixed fashion at a prescribed location within first member 8. First fixing member 26 is of bowl-like shape and has hole(s) at the base portion thereof, engagement of this bowl-like region by the spherically shaped first elastic member 18 causing first elastic member 18 to be held in fixed fashion at the prescribed location.

First filter member 20 is a member which acts to prevent debris (hereinafter also referred to as "unwanted material") 46 from elastic members 18, 40, generated by second hollow needle member 34 when—as will be described below—it penetrates elastic members 18, 40 and is inserted within first hollow needle member 12, from being able to enter the interior of first hollow needle member 12. First filter member 20 is arranged between hole(s) present in base portion 16 of first hollow needle member 12 and first elastic member 18.

Figure 5:
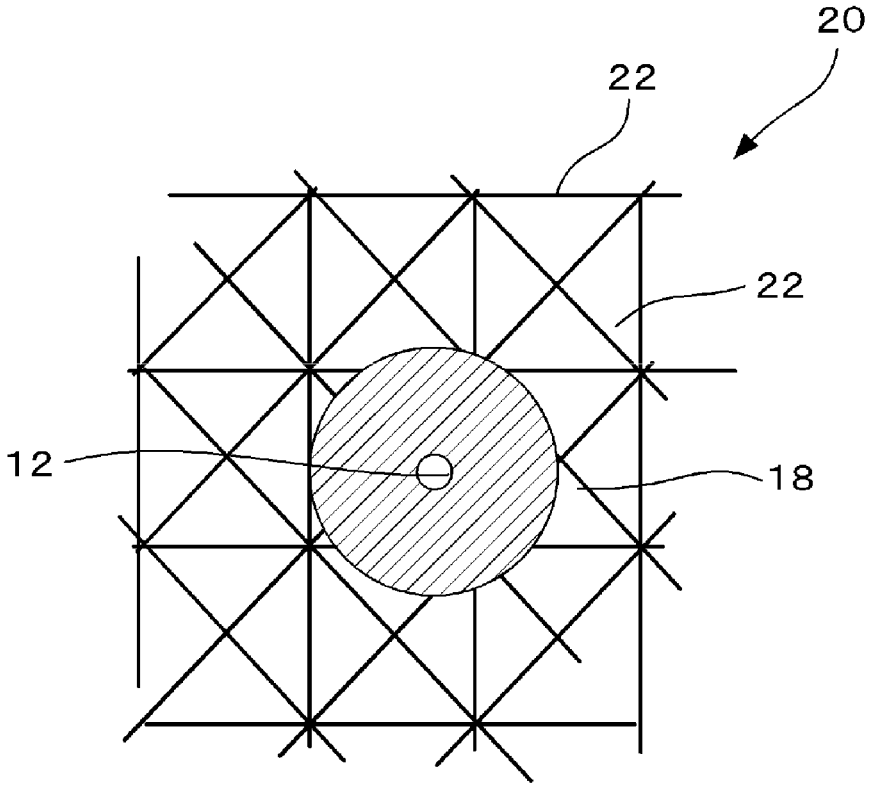
FIG. 5 Plan view to assist in describing principal parts of a first filter member associated with the present embodiment.

FIG. 5 is a drawing to assist in describing the structure of first filter member 20 at this time. As shown in FIG. 5, first filter member 20 is constituted such that there is a screen-like member 22 in which thread-like member(s) are arranged in screen-like (lattice-like) fashion, over which and rotated with respect to which by on the order of 45° there is a screen-like member 22. Note, however, that whereas first filter member 20 is a member which is installed for the purpose of preventing debris 46 which may be produced by scraping of elastic members 18, 40 due to action of second hollow needle member 34 from being able to enter the interior of first hollow needle member 12, so long as this purpose is achieved, it is not limited to the foregoing constitution.

Second filter member 24, like first filter member 20, is a member which acts to prevent unwanted material 46 generated by second hollow needle member 34 from being able to enter the interior of first hollow needle member 12 (particularly tip portion 14). Second filter member 24 is installed within the interior of first hollow needle member 12. There is no limitation with respect to the material or structure of second filter member 24 so long as the foregoing purpose is achieved.

Figure 6:
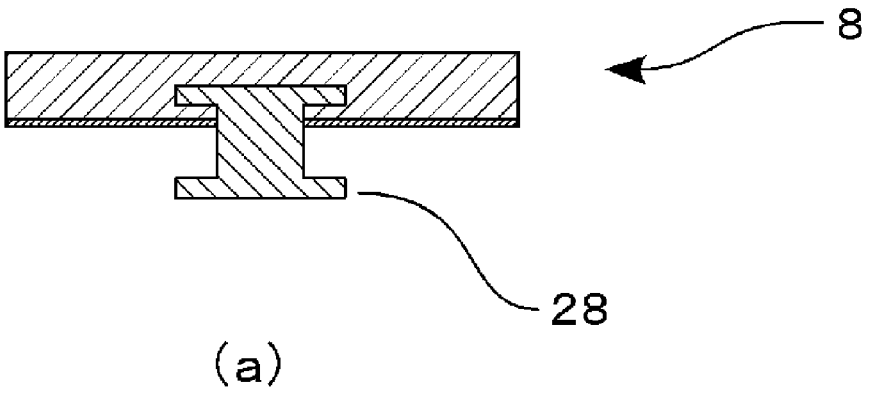
FIG. 6 Drawing to assist in describing principal parts of a drug container gripping portion associated with the present embodiment.
Figure 6:
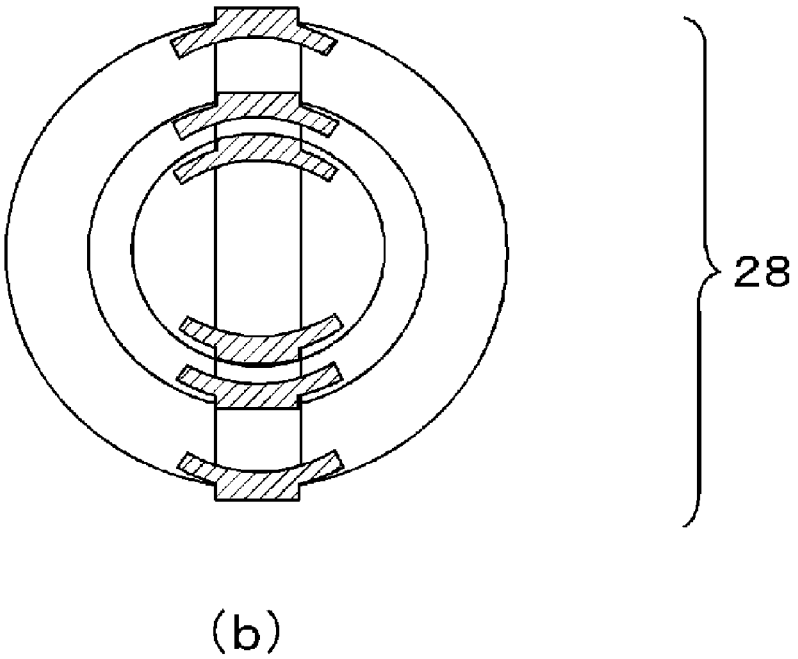
Figure 7:
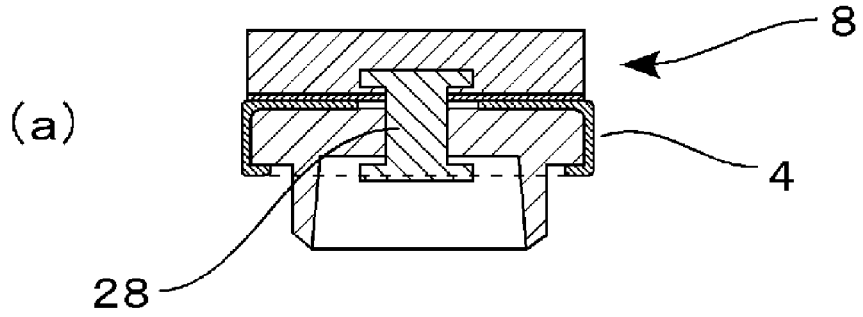
FIG. 7 Drawing to assist in describing examples of how a drug container gripping portion associated with the present embodiment may be applied in various situations.
Figure 7:
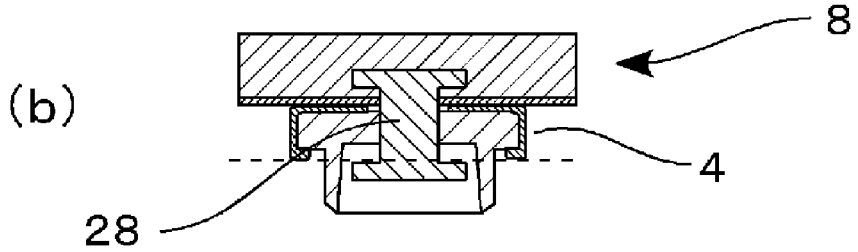
Figure 7:
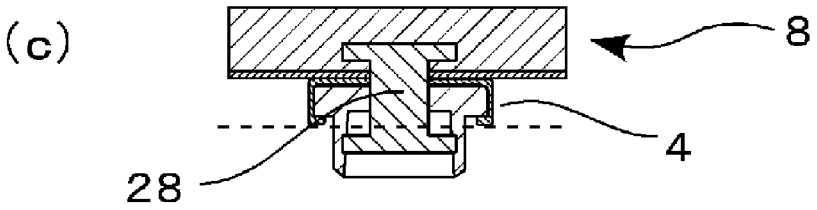

Next, FIG. 6 and FIG. 7 will be used to describe drug container gripping portion 28. FIG. 6 (*a*) is a front view to assist in describing the principal parts of drug container gripping portion 28; FIG. 6 (*b*) is a plan view to assist in describing the principal parts of drug container gripping portion 28. FIG. 7 (*a*) through (*c*), are respectively drawings to assist in describing how the size of drug container gripping portion 28 might be varied so as to accommodate stoppers 4 of various size.

Stopper 4 of drug container 2 may be of various sizes, the diameter of the opening being 15 mm, 20 mm, 30 mm, or the like. Accordingly, as shown at FIG. 6 (*a*), drug container gripping portion 28 is a member which, by squeezing on the stopper 4 and/or nose portion of drug container 2 from the side(s) thereof, causes the mutually connected relationship between drug container 2 and first member 8 to be made fixed. Furthermore, as shown at FIG. 6 (*b*), drug container gripping portion 28 is such that size(s) of region(s) at which connection is made can be adjusted so as to be size(s) of stopper(s) 4 (and/or nose portion(s)) of drug container(s) 2.

In addition, as respectively shown at FIG. 7 (*a*) through (*c*), drug container gripping portion 28 is such that the size of the region at which connection occurs is made to correspond to the size of stopper 4 (and/or the nose portion) of drug container 2, so that when stopper 4 (and/or the nose portion) is squeezed on from both the left and right sides thereof, and/or from all four sides thereof, this causes the mutually connected relationship between drug container 2 and first member 8 to be made fixed.

Figure 8:
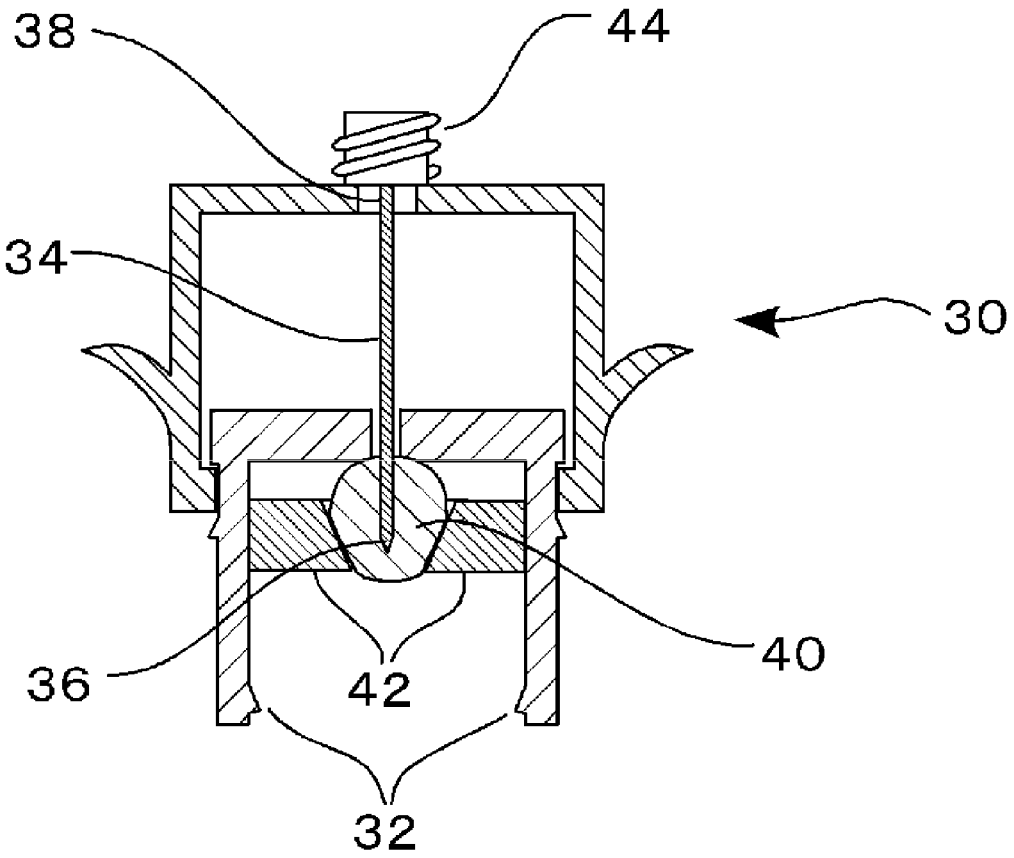
FIG. 8 Sectional view to assist in describing principal parts of a second member associated with the present embodiment.

Next, FIG. 8 will be used to describe second member 30. FIG. 8 is a sectional view to assist in describing the principal parts of second member 30. As shown in FIG. 8, second member 30 has syringe barrel connection portion(s) 44, engagement mechanism female portion(s) 32, second hollow needle member(s) 34, second elastic member(s) 40, and second fixing member(s) 42.

Syringe barrel connection portion 44, which is the region which makes connection with syringe barrel 6 into which the liquid or gas drug which is delivered will be deposited, is located at the end which is opposite the region that makes connection with first member 8. There is no particular limitation with respect to the mechanism by means of which syringe barrel connection portion 44 and syringe barrel 6 are mutually connected.

Engagement mechanism female portion 32, which is the female portion of an engagement mechanism (locking mechanism) for causing mutual connection between first member 8 and second member 30, causes first member 8 and second member 30 to be mutually connected by means of a simple operation as a result of engagement with male portion 10 provided on first member 8. This engagement mechanism might for example be a mechanism comprising a pawl-shaped female portion and a male portion shaped so as to engage with this pawl, first member 8 and second member 30 being capable of being easily locked in connected relationship as a result of the mutual engagement which is made to occur between this pawl and this region that engages with the pawl. Note that the foregoing engagement mechanism may have a structure which is other than this.

Second hollow needle member 34, which is needle-shaped and has hollow interior, is such that tip portion 36 thereof is arranged so as to be directed toward first member 8 (first hollow needle member 12), and is such that base portion 38 thereof is arranged so as to be directed toward the portion (syringe barrel connection portion 44) which makes connection with syringe barrel 6. Furthermore, tip portion 36 is supported in such state that it is inserted within second elastic member 40, described below, and base portion 38 is held in fixed fashion by syringe barrel connection portion 44. Moreover, during delivery of drug(s), first member 8 and second member 30 are mutually connected, and second hollow needle member 34 is inserted within first hollow needle member 12. This being the case, as the orientation of second hollow needle member 34 is held in fixed fashion so as to be in a prescribed direction, member 8, 30 interconnection operations (hollow needle member 12, 34 insertion operations) can be carried out easily and definitively.

Furthermore, because liquid drug delivery between drug container 2 and syringe barrel 6 is carried out by way of second hollow needle member 34, hole(s) for delivery of drug(s) are provided at least at tip portion 36 and base portion 38.

Second elastic member 40 might for example be a spherically shaped member, the material of which is silicon, thermoplastic resin, or other such substance provided with elasticity. Furthermore, second elastic member 40 is held in fixed fashion at a prescribed location within second member 30 by second fixing member 42. Here, what is meant by a prescribed location is a location such that, when first member 8 and second member 30 are mutually connected, first elastic member 18 and second elastic member 40 are made to mutually abut such that there is a prescribed force therebetween.

Second fixing member 42, as has been described, is a member for holding second elastic member 40 in fixed fashion at a prescribed location within second member 30. Second fixing member 42, which is of bowl-like shape and has hole(s) at the base portion thereof, engagement of this bowl-like region by the spherically shaped second elastic member 40 causing second elastic member 40 to be held in fixed fashion at the prescribed location.

Figure 9:
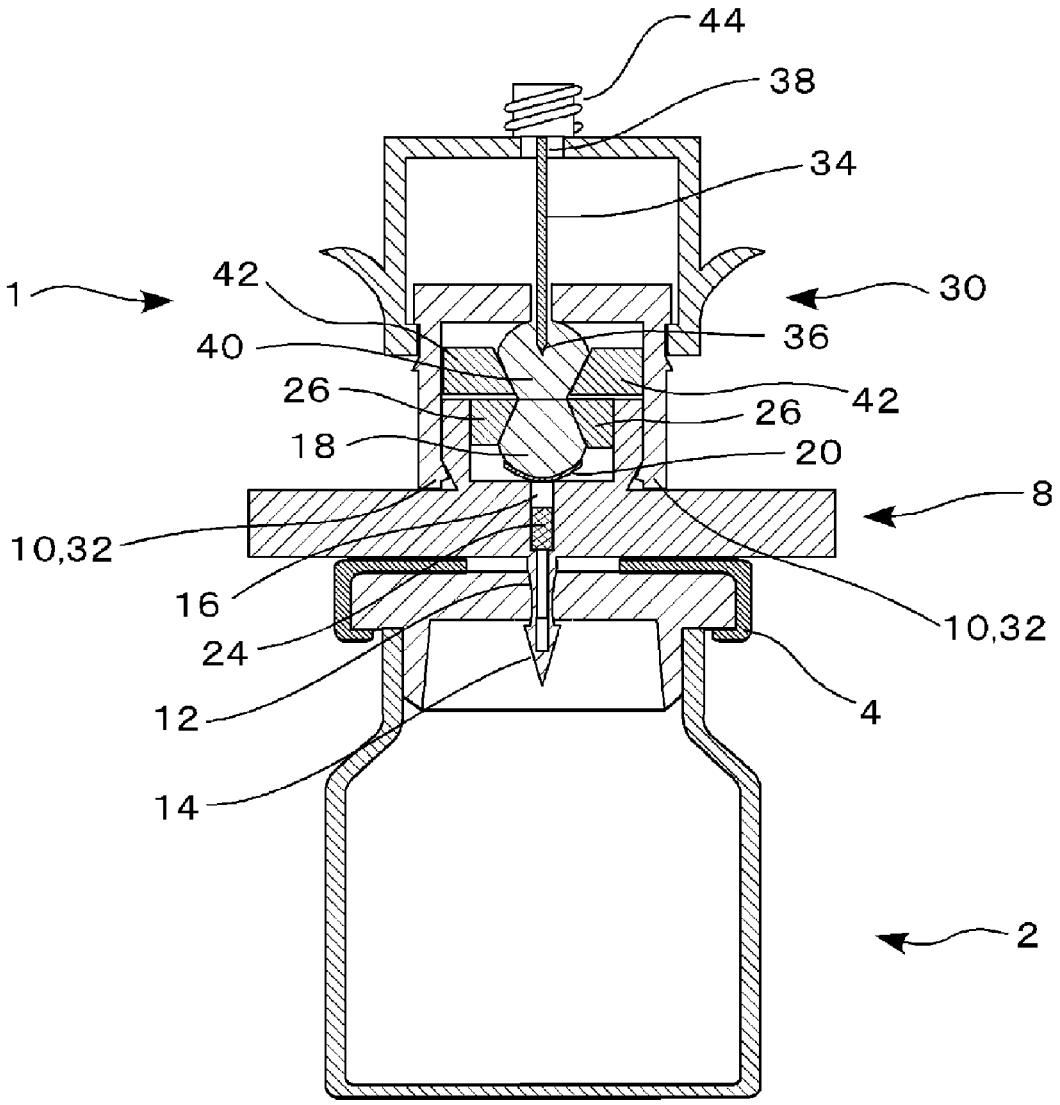
FIG. 9 Sectional view to assist in describing a way in which a first member and a second member associated with the present embodiment might be connected.
Figure 10:
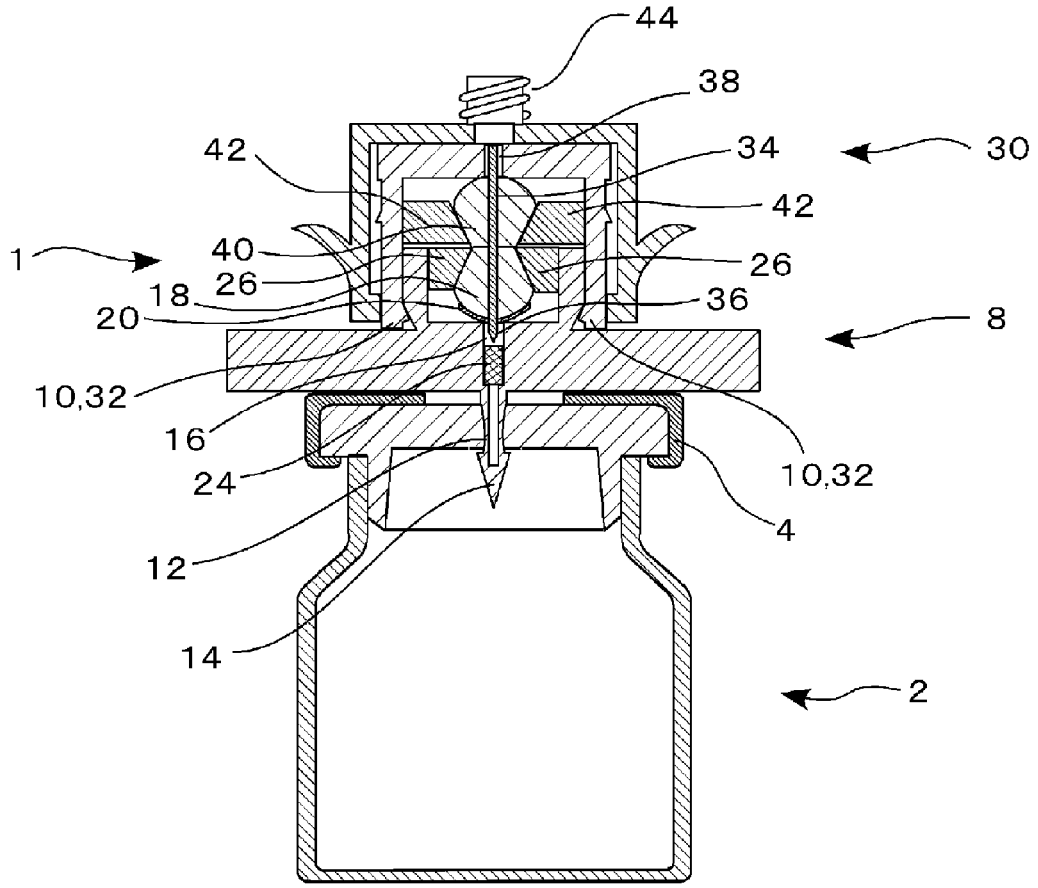
FIG. 10 Sectional view to assist in describing a way in which a first member and a second member associated with the present embodiment might be connected.

Next, FIG. 9 and FIG. 10 will be used to describe the manner in which first member 8 and second member 30 are connected. FIG. 9 and FIG. 10 are sectional views to assist in describing ways in which first member 8 and second member 30 may be connected.

As shown in FIG. 9, in a first procedure, male portion 10 and female portion 32 of an engagement mechanism for causing first member 8 and second member 30 to be mutually connected are mutually engaged, causing first member 8 and second member 30 to be mutually connected. While in this state, first elastic member 18 and second elastic member 40 mutually abut, the region where elastic members 18, 40 abut assumes a squashed state, and the region where first member 8 and second member 30 mutually connect becomes a closed system which is closed off from the exterior.

In addition, as shown in FIG. 10, in a second procedure, while maintaining the foregoing state without alteration, tip portion 36 of second hollow needle member 34, which is supported by second elastic member 40, is pressed upon and made to advance so as to penetrate the interior of second elastic member 40 and first elastic member 18, such that the interior of first hollow needle member 12 is entered from base portion 16. At such time, because there is a possibility that second hollow needle member 34 will scrape off matter from elastic members 18, 40, first filter member 20 and second filter member 24 are employed to prevent such debris 46 which may be produced by scraping from being able to pass therethrough.

In addition, tip portion 14 of first hollow needle member 12 is inserted into stopper 4 of drug container 2, such that liquid drug delivery between drug container 2 and syringe barrel 6 occurs by way of hollow needle members 12, 34.

(Method for Using Drug Delivery Device Associated with Present Embodiment)

FIG. 1, FIG. 2, FIG. 4, FIG. 6, FIG. 7, FIG. 9, and FIG. 10 will be used to describe methods for using drug delivery device 1; and more specifically, methods for delivering drug(s) between drug container(s) 2 and syringe barrel(s) 6 in the context of drug delivery system(s) 100 which include drug delivery device(s) 1. Note that the present description is predicated on drug delivery where drug container 2 is a vial as shown in FIG. 1, and/or is predicated on drug delivery where drug container 2 is an infusion bag as shown in FIG. 2.

In the first procedure, when an operator causes tip portion 14 of first hollow needle member 12 provided on first member 8 shown in FIG. 4 to be inserted in stopper portion 4 of drug container 2, this causes mutual connection to be made between drug container 2 and first member 8.

In the second procedure, when as shown in FIG. 6 and FIG. 7 an operator adjusts the size of drug container gripping portion 28 so that it corresponds to the magnitude of the diameter of the opening in stopper portion 4 of drug container 2, and causes stopper portion 4 (and/or the nose portion) to be squeezed on from both the left and right sides thereof, and/or from all four sides thereof, this causes the mutually connected relationship between drug container 2 and first member 8 to be made fixed.

In a third procedure, when an operator causes male portion 10 and female portion 32 of an engagement mechanism to be mutually engaged as shown in FIG. 9, this causes first member 8 and second member 30 to be mutually connected. While in this state, first elastic member 18 and second elastic member 40 mutually abut, the region where elastic members 18, 40 abut assumes a squashed state, and the region where first member 8 and second member 30 mutually connect becomes a closed system which is closed off from the exterior.

In a fourth procedure, as shown in FIG. 10, while maintaining without alteration the state reached at the conclusion of the third procedure, an operator causes tip portion 36 of second hollow needle member 34, which is supported by second elastic member 40, to be pressed upon and made to advance so as to penetrate the interior of second elastic member 40 and first elastic member 18. Moreover, the operator causes second hollow needle member 34 to be inserted within the interior of first hollow needle member 12 from base portion 16. At such time, because there is a possibility that second hollow needle member 34 will scrape off matter from elastic members 18, 40, first filter member 20 and second filter member 24 are employed to prevent such debris 46 which may be produced by scraping from being able to pass therethrough.

In a fifth procedure, as shown in FIG. 1 and/or FIG. 2, an operator causes syringe barrel 6 to be connected to syringe barrel connection portion 44 provided on second member 30.

In a sixth procedure, an operator causes drug(s) to be delivered from syringe barrel 6 to drug container 2, and/or from drug container 2 to syringe barrel 6. At such time, the operator carries out delivery of drug(s) by turning drug container 2 upside-down or by appropriately actuating syringe barrel 6.

(Wrapup)

As a result of being provided with engagement mechanism male portion(s) 10 provided by first member(s) 8 and engagement mechanism female portion(s) 32 provided by second member(s) 30, drug delivery device 1 is such that connection of first member(s) 8 and second member(s) 30 can be carried out easily and definitively.

At drug delivery device 1, because tip portion 36 is supported in a state in which it is inserted in second elastic member 40, and because base portion 38 is held in fixed fashion by syringe barrel connection portion 44, the orientation of second hollow needle member 34 is held in fixed fashion so as to be in a prescribed direction, as a result of which member 8, 30 interconnection operations can be carried out easily and definitively.

At drug delivery device 1, because the region where elastic members 18, 40 abut is made to assume a squashed state, the region where members 8, 30 connect becomes a closed system which is closed off from the exterior. In addition, at drug delivery device 1, because second hollow needle member 34 is inserted within first hollow needle member 12 by way of the foregoing closed system, and because drug delivery between drug container 2 and syringe barrel 6 also occurs by way of hollow needle members 12, 34, dripping or leakage of the drug to the exterior does not occur.

At drug delivery device 1, as a result of installation of first filter member(s) 20 and second filter member(s) 24, entry of unwanted material 46 into drug container(s) 2 is aggressively prevented.

Because drug delivery device 1 is provided with drug container gripping portion 28, connection in fixed fashion with first member 8 can be carried out for drug containers 2 having stopper opening diameters of a wide variety of magnitudes, as a result of which it is possible to carry out drug delivery in the context of a closed system with a wide variety of drug containers 2.

While embodiments of the present invention have been described in detail above, the present invention is not limited to any such particular embodiment, variation and/or alteration being possible within the range of the gist of the present invention as recited at the claims.

EXPLANATION OF REFERENCE NUMERALS

1 Drug delivery device
2 Drug container
4 Drug container stopper
6 Syringe barrel
8 First member
10 Engagement mechanism male portion
12 First hollow needle member
14 First hollow needle member tip portion
16 First hollow needle member base portion
18 First elastic member
20 First filter member
22 Screen-like member
24 Second filter member
26 First fixing member
28 Drug container gripping portion
30 Second member
32 Engagement mechanism female portion
34 Second hollow needle member
36 Second hollow needle member tip portion
38 Second hollow needle member base portion
40 Second elastic member
42 Second fixing member
44 Syringe barrel connection portion
46 Unwanted material
100 Drug delivery system

The invention claimed is:

1. A drug delivery device which has a first member that is connected to a stopper side of a drug delivery device, and a second member that is connected at one end thereof to said first member and that is connected at another end thereof to a syringe barrel, and which carries out delivery of a drug between the drug container and the syringe barrel, the drug delivery device comprising:

the first member has a male portion of an engagement mechanism for causing mutual connection to be made between said first member and the second member, and the second member has a female portion of said engagement mechanism, mutual engagement between the male portion and the female portion causing mutual connection to be made between the first member and the second member;

wherein the second member has a sleeve portion configured to move relative to said female portion between a first state and a second state and a second hollow needle member fixedly mounted on said sleeve portion having a tip portion arranged so as to be directed toward the first member, and having a base portion arranged so as to be directed toward the syringe barrel, wherein the base portion is held in fixed fashion by said sleeve portion via which connection is made with the syringe barrel, a hole for delivery of the drug being provided at each the base portion and at the tip portion; and a second elastic member capable of being penetrated by the second hollow needle member;

wherein the tip portion of the second hollow needle member is supported in said first state such that said tip portion is located inside of the second elastic member;

wherein the first member has a first elastic member capable of being penetrated by the second hollow needle member; and a first hollow needle member having a tip portion arranged so as to be directed toward the stopper side of the drug delivery device, and having a base portion arranged so as to be directed toward the second member, the base portion and the tip portion each being provided with a hole, an inside diameter of which is larger than an outside diameter of the second hollow needle member, for delivery of the drug;

wherein, when the hole toward the base portion side of the first hollow needle member is occluded by the first elastic member, and the first member and the second member are mutually connected, while in a mutually connected state between said first member and said second member in which the first elastic member and the second elastic member mutually abut, said sleeve portion of said second member is movable to said second state such that the second hollow needle member penetrates said the first elastic member and second elastic member, and is inserted within the first hollow needle member which is inserted within the stopper of the drug container; and wherein delivery of the drug between the drug container and the syringe barrel is carried out by way of the first hollow needle member and the second hollow needle member which is inserted within said first hollow needle member while in said mutually connected state between said first member and said second member with said sleeve portion in said second state.

2. A drug delivery device according to claim 1 wherein a first filter member for preventing entry of unwanted material into the first hollow needle member is provided between the hole at the base portion side of the first hollow needle member and the first elastic member, wherein said second hollow needle member extends through said first filter member during said mutually connected state between said first member and said second member with said sleeve portion in said second state.

3. A drug delivery device according to claim 1 wherein provided at an interior of the first hollow needle member is a second filter member for preventing entry of unwanted material into the top portion of said first hollow needle member, wherein said second hollow needle member extends through said second filter member during said mutually connected state between said first member and said second member with said sleeve portion in said second state.

4. A drug delivery device according to claim 1 wherein the first elastic member and the second elastic member are spherically shaped;

a first fixing member that holds the first elastic member to the first member in fixed fashion, and a second fixing member that holds the second elastic member to the second member in fixed fashion, are each of bowl-like shape and have a hole at a base portion thereof;

wherein arranging the first elastic member and the second elastic member at the bowl-like regions causes locations of the first elastic member and the second elastic member to be fixed.

5. A drug delivery device according to claim 1 wherein the first member has a drug container gripping portion that allows a size of a region at which connection occurs to be made to correspond to a magnitude of an outside diameter at the drug container stopper portion, and that squeezes on and holds the drug container stopper portion.

6. A drug delivery device according to claim 2 wherein the first filter member takes the form of a screen-like member in which a thread-like member is arranged in screen-like fashion, over which and rotated with respect to which by 45° there is a said screen-like member.

* * * * *